US010104938B2

(12) United States Patent
Auger et al.

(10) Patent No.: US 10,104,938 B2
(45) Date of Patent: Oct. 23, 2018

(54) INTERCHANGEABLE CLEAT SYSTEM FOR FOOTWEAR

(71) Applicant: NIKE, Inc., Beaverton, OR (US)

(72) Inventors: Perry W. Auger, Tigard, OR (US); Andrew Caine, Portland, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/642,193

(22) Filed: Mar. 9, 2015

(65) Prior Publication Data

US 2015/0237964 A1 Aug. 27, 2015

Related U.S. Application Data

(63) Continuation of application No. 13/219,867, filed on Aug. 29, 2011, now Pat. No. 8,997,381.

(51) Int. Cl.

| | |
|---|---|
| ***A43C 15/16*** | (2006.01) |
| ***A43B 13/22*** | (2006.01) |
| ***A43B 13/26*** | (2006.01) |

(52) U.S. Cl.

CPC ..... *A43C 15/161* (2013.01); *A43B 13/223* (2013.01); *A43B 13/26* (2013.01);

(Continued)

(58) Field of Classification Search

CPC ..... A43C 15/161; A43C 15/16; A43C 15/167; A43C 15/162; A43C 15/164;

(Continued)

(56) References Cited

U.S. PATENT DOCUMENTS

| | | | |
|---|---|---|---|
| 1,594,056 | A | 7/1926 | Floyd |
| 1,867,915 | A | 7/1932 | Goldsmith |

(Continued)

FOREIGN PATENT DOCUMENTS

| | | | |
|---|---|---|---|
| CN | 1285174 | A | 2/2001 |
| CN | 101611949 | A | 12/2009 |

(Continued)

OTHER PUBLICATIONS

Office Action dated Jan. 18, 2016 for Chinese Patent Application No. 2012800410611.

(Continued)

*Primary Examiner* — Katharine Gracz

(74) *Attorney, Agent, or Firm* — Honigman Miller Schwartz and Cohn LLP; Matthew H. Szalach; Jonathan P. O'Brien

(57) ABSTRACT

An interchangeable cleat system for an article of footwear includes an outer sole member with a plurality of fixed cleat members and a plurality of removable cleat members. The spacing between the removable cleat members and the fixed cleat members may be approximately constant in at least one portion of the article of footwear. The differences in height between the removable cleat members and the fixed cleat members may be approximately constant within a portion of the outer sole member. The cleat system can include at least three sets of cleat members that can be interchanged over different portions of the outer sole member.

14 Claims, 10 Drawing Sheets

(52) U.S. Cl.
CPC ..... *A43C 15/16* (2013.01); *A43C 15/162* (2013.01); *A43C 15/167* (2013.01)

(58) Field of Classification Search
CPC ..... A43C 15/165; A43B 13/223; A43B 13/26; A43B 5/02; A43B 5/001
USPC ..... 36/102, 103, 134, 67 R, 67 D, 67 A, 62, 36/59 C; D2/962
See application file for complete search history.

(56) References Cited

U.S. PATENT DOCUMENTS 2,292,238 A 8/1942 Pierce et al.
2,607,135 A 8/1952 Langer
3,988,840 A 11/1976 Minihane
4,167,071 A 9/1979 Koransky
4,294,024 A 10/1981 Nab
4,327,503 A 5/1982 Johnson
4,380,878 A * 4/1983 Skaja ..... A43B 13/26 36/129
4,393,604 A 7/1983 Crowley
4,454,662 A * 6/1984 Stubblefield ..... A43B 5/00 36/102
4,523,396 A 6/1985 Dassler
4,527,345 A 7/1985 Lopez Lopez
4,590,693 A 5/1986 Kawashima et al.
4,667,425 A * 5/1987 Effler ..... A43B 13/223 36/114
4,782,604 A 11/1988 Wen-Shown
4,787,156 A * 11/1988 Bade ..... B29D 35/081 12/142 T
5,293,701 A 3/1994 Sullivan
D351,495 S * 10/1994 Nagai ..... D2/959
5,461,801 A * 10/1995 Anderton ..... A43B 3/0052 24/713.4
6,016,613 A * 1/2000 Campbell ..... A43B 5/001 36/127
D427,754 S * 7/2000 Portaud ..... D2/954
6,161,315 A 12/2000 Dalton
D443,407 S * 6/2001 Patterson ..... D2/946
6,338,208 B1 1/2002 Waterbury
6,352,319 B1 3/2002 Grant
6,354,022 B2 3/2002 Gelsomini
6,543,160 B2 4/2003 Price
6,705,027 B1 * 3/2004 Campbell ..... A43B 5/001 36/127
6,793,996 B1 9/2004 Umezawa
6,948,264 B1 9/2005 Lyden
6,973,745 B2 * 12/2005 Mills ..... A43B 3/0068 36/113
6,973,746 B2 * 12/2005 Auger ..... A43B 1/0072 36/128
7,010,871 B2 * 3/2006 Sussmann ..... A43C 15/02 36/59 A
7,073,280 B2 7/2006 Terashima
7,827,705 B2 11/2010 Baucom et al.
7,866,064 B2 * 1/2011 Gerber ..... A43B 13/36 36/100
8,713,819 B2 * 5/2014 Auger ..... A43B 5/02 36/102
9,210,967 B2 * 12/2015 Gerber ..... A43B 5/02
2004/0000075 A1 1/2004 Auger et al.
2004/0148806 A1 * 8/2004 Sussmann ..... A43C 15/02 36/115
2006/0021255 A1 * 2/2006 Auger ..... A43B 5/02 36/67 A
2008/0196274 A1 * 8/2008 Gerber ..... A43C 15/161 36/100
2008/0271346 A1 11/2008 Farmer
2009/0100716 A1 4/2009 Gerber
2009/0100718 A1 * 4/2009 Gerber ..... A43B 13/145 36/128
2011/0088287 A1 4/2011 Auger et al.
2012/0291315 A1 * 11/2012 Baucom ..... A43B 1/0018 36/134

FOREIGN PATENT DOCUMENTS

DE 2721336 A1 11/1978
DE 4417563 A1 11/1995
DE 19817579 A1 10/1999
GB 2223394 A 4/1990
WO 9009117 A1 8/1990
WO 2008139014 A2 11/2008

OTHER PUBLICATIONS

Response to Office Action as filed Apr. 5, 2016 for Chinese Patent Application No. 2012800410611.
Communication pursuant to Rule161(1) and 162 EPC dated Apr. 11, 2014 for European Patent Application No. EP12772552.1.
International Preliminary Report on Patentability for Application No. PCT/US2012/052599, dated Mar. 13, 2014.
International Search Report and Written Opinion for Application No. PCT/US2012/052599, dated Jan. 17, 2013.
Response to Communication pursuantto Rule161(1) and 162EPC dated Apr. 11,2014 for European Patent Application No. EP12772552.1 as filed on Oct. 10, 2014.
Response to Office Action dated May 5, 2015 in Chinese Patent Application No. 2012800410611 and the English translation thereof, as filed on Sep. 21, 2015.
European Patent Office, Communication pursuant to Article 94(3) EPC for Application No. EP 12772552.1, dated Nov. 9, 2017.
European Patent Office, Communication Pursuant to Article 94(3) EPC for Application No. 12772552.1, dated Jul. 3, 2018.
State Intellectual Property Office (PRC), Office Action for CN Application No. 201710293421.1, dated May 2, 2018.

* cited by examiner

INTERCHANGEABLE CLEAT SYSTEM FOR FOOTWEAR

CROSS-REFERENCE TO RELATED APPLICATION

This application is a continuation of U.S. Pat. No. 8,997,381, now U.S. application Ser. No. 13/219,867, entitled "Interchangeable Cleat System For Footwear", filed on Aug. 29, 2011, and allowed on Dec. 9, 2014, which patent is hereby incorporated by reference in its entirety.

BACKGROUND

The present embodiments relate generally to articles of footwear, and in particular to articles of footwear with interchangeable cleat systems.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, an outer sole member for an article of footwear includes a cleat system including a plurality of fixed cleat members and a plurality of removable cleat members. The plurality of fixed cleat members include a first group of fixed cleat members disposed in a first portion of the outer sole member and a second group of fixed cleat members disposed in a second portion of the outer sole member. The plurality of removable cleat members include a first group of removable cleat members disposed in the first portion of the outer sole member and a second group of removable cleat members disposed in the second portion of the outer sole member. The first group of fixed cleat members has a first height and the first group of removable cleat members has a second height. The second group of fixed cleat members has a third height and the second group of removable cleat members has a fourth height. The difference between the first height and the second height is approximately equal to the difference between the third height and the fourth height.

In another aspect, a kit of parts includes an outer sole member. The outer sole member includes a plurality of fixed cleat members and a plurality of cleat receiving portions for receiving removable cleat members. The kit of parts also includes a first set of removable cleat members associated with a first height, a second set of removable cleat members associated with a second height and a third set of removable cleat members associated with a third height. The difference between the first height and the second height is approximately equal to the difference between the second height and the third height.

In another aspect, an outer sole member for an article of footwear includes a cleat system including a plurality of fixed cleat members and a plurality of removable cleat members. The plurality of fixed cleat members has a ridge-like shape, where a majority of the plurality of fixed cleat members are disposed on an outer peripheral region of the outer sole member. The plurality of removable cleat members has a conical tapered shape, where a majority of the plurality of removable cleat members are disposed on the outer peripheral region of the outer sole member. The spacing between each removable cleat member and a corresponding closest fixed cleat member is approximately constant.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
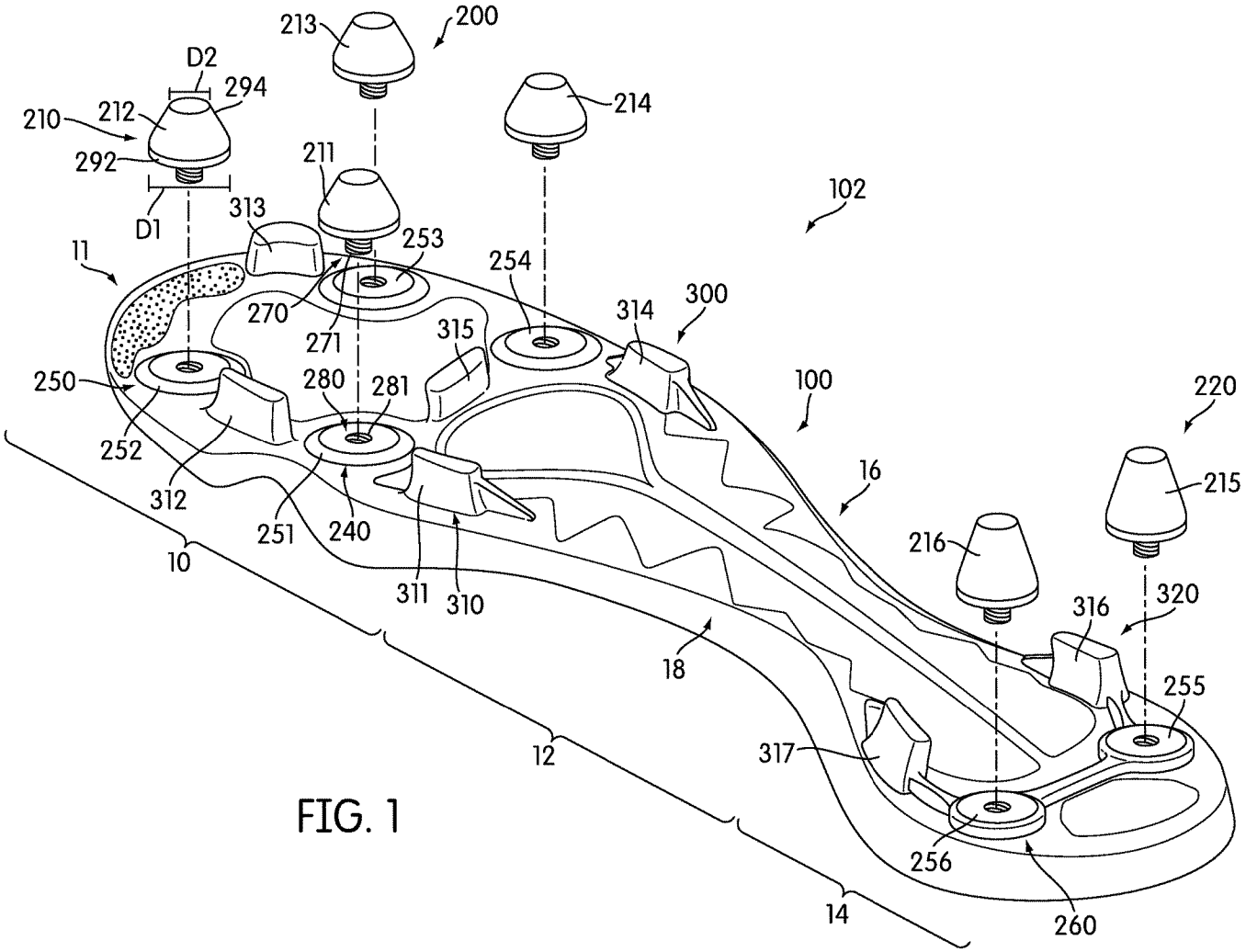
FIG. 1 is an isometric view of an embodiment of an outer sole member including a cleat system, with a plurality of removable cleat members unattached.
Figure 2:
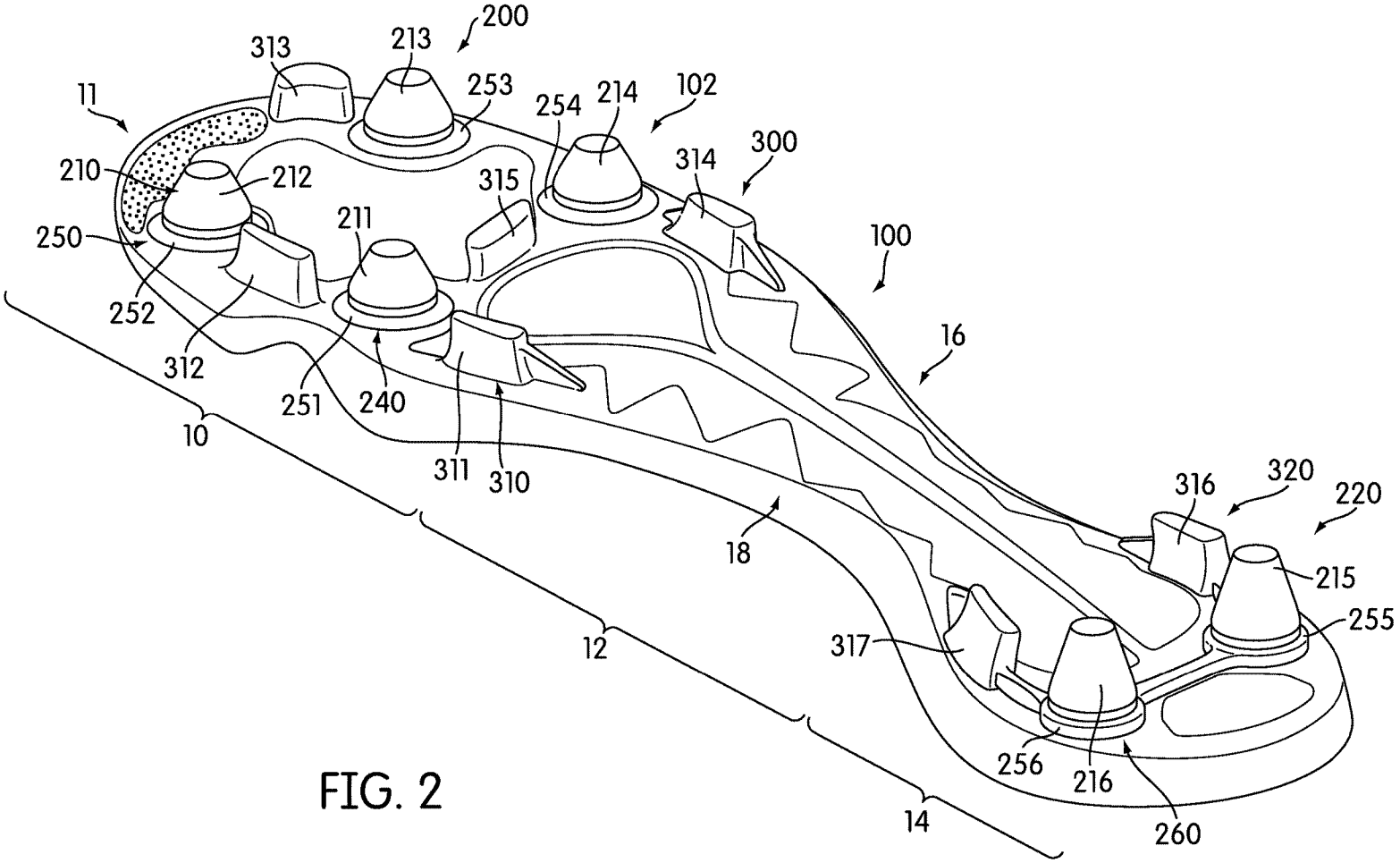
FIG. 2 is an isometric view of an embodiment of an outer sole member including a cleat system, with a plurality of removable cleat members attached.
Figure 3:
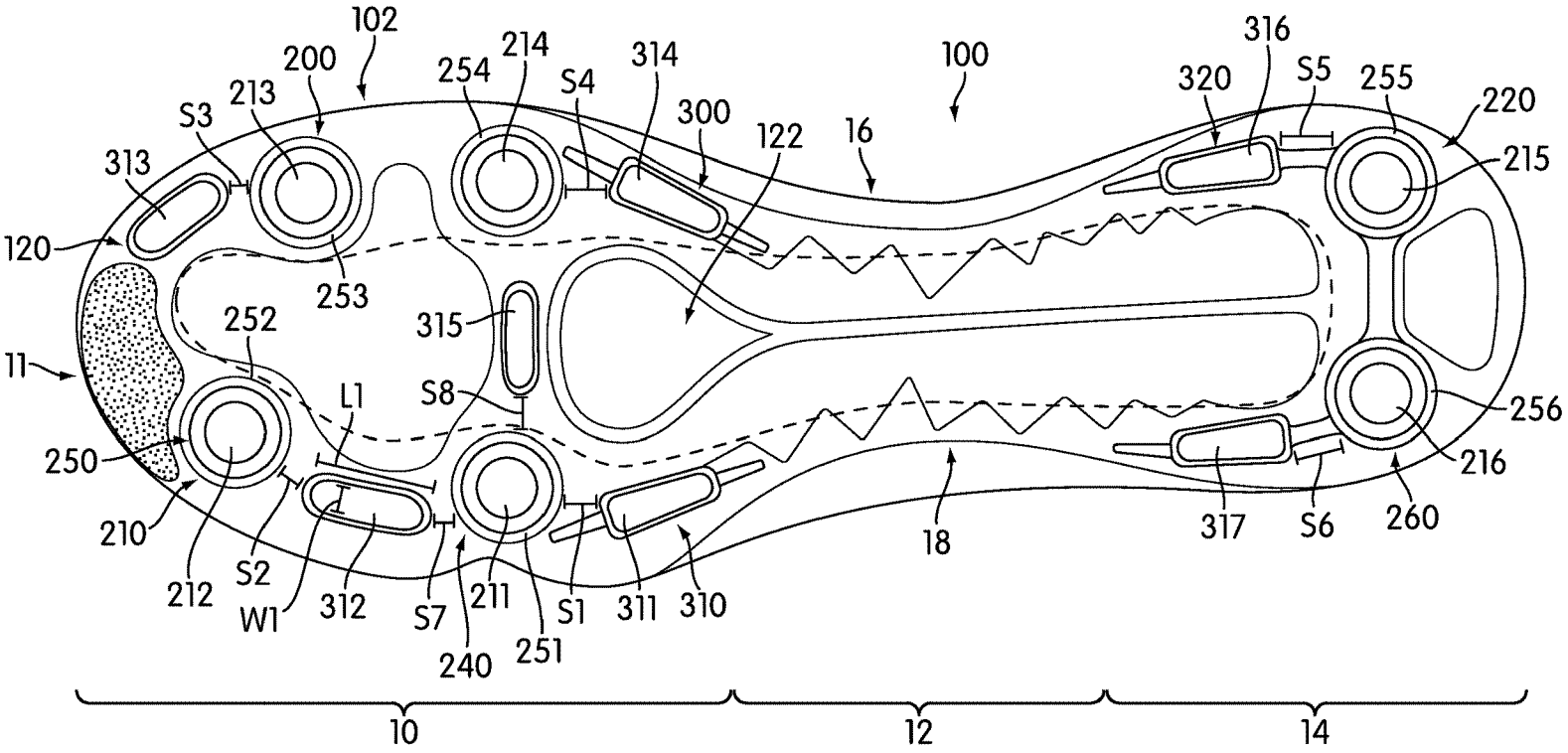
FIG. 3 is a bottom view of an embodiment of an outer sole member including a cleat system.

FIGS. 1 through 3, illustrate views of an embodiment of outer sole member 100 that may be incorporated into an article of footwear. Outer sole member 100 could be incorporated into any type of footwear including, but not limited to: hiking boots, soccer shoes, football shoes, sneakers, rugby shoes, basketball shoes, baseball shoes as well as other kinds of shoes. As shown in FIGS. 1 through 3, outer sole member 100 is intended to be used with a right foot; however, it should be understood that the following discussion may equally apply to a mirror image of outer sole member 100 that is intended for use with a left foot.

For consistency and convenience, directional adjectives are employed throughout this detailed description corresponding to the illustrated embodiments. The term "longitudinal" or "longitudinally" as used throughout this detailed description and in the claims refers to a direction extending a length of a component. In some cases, the longitudinal axis is the axis extending through the longest dimension of a component. For example, the longitudinal axis of a cleat may be the direction extending through the longest portion of the stud.

The term "medial plane of the body" as used throughout this detailed description and in the claims refers to the plane that divides the human body into a right and left side. The term "lateral" as used throughout this detailed description and in the claims refers to a region or direction extending away from the medial plane of the body. For example, the lateral side of a footwear component may refer to the side of the component facing away from the center of the body. Similarly, the term "medial" as used throughout this detailed description and in the claims refers to a region or direction extending towards the medial plane of the body. For example, the medial side of a footwear component may refer to the side of the component facing towards the center of the body. Furthermore, the term "vertical" as used throughout this detailed description and in the claims refers to a direction that is generally perpendicular to the longitudinal direction as well as a direction extending between the lateral and medial sides of a component.

The components discussed herein may vary in size in different dimensional directions. It should be understood that the terms "length" and "width" as used throughout this detailed description and in the claims refers to a direction generally associated with the longest and shortest dimensions, respectively, of an element in the plane approximately parallel to the sole structure. It should also be understood that the term "height" as used throughout this detailed description and in the claims refers to a direction generally associated with the distance of an element as measured from the sole structure in the plane approximately perpendicular to the sole structure.

Referring to FIGS. 1 through 3, for purposes of reference, outer sole member 100, or simply sole member 100, may be divided into a forefoot portion 10, midfoot portion 12, and heel portion 14. Forefoot portion 10 may be generally associated with the toes and joints connecting the metatarsals with the phalanges. The forefoot portion 10 may further include a front-tip portion 11 associated with the front tip of the sole member 100. Midfoot portion 12 may be generally associated with the arch of a foot. Likewise, heel portion 14 may be generally associated with the heel of a foot, including the calcaneus bone.

In addition, sole member 100 may include a medial edge 16 and lateral edge 18. In particular, medial edge 16 may refer to the edge of the sole member 100 facing away from the center of the body. Similarly, the lateral edge 18 may refer to the region of the sole member 100 that is facing towards the center of the body. Furthermore, both medial edge 16 and lateral edge 18 may extend through forefoot region 10, midfoot region 12, and heel region 14.

It will be understood that forefoot portion 10, midfoot portion 12, and heel portion 14 are only intended for purposes of description and are not intended to demarcate precise regions of sole member 100. Likewise, medial edge 16 and lateral edge 18 are intended to represent generally two portions or sides of the sole member 100, rather than precisely demarcating the sole member 100 into two halves. In addition, forefoot portion 10, midfoot portion 12, and heel portion 14, as well as medial edge 16 and lateral edge 18, can also be applied to individual components of an article of footwear, such as a sole structure and/or an upper.

Sole member 100 may attenuate ground reaction forces when compressed between the foot and the ground during walking, running or other ambulatory activities. The configuration of sole member 100 may vary significantly in different embodiments to include a variety of conventional or non-conventional structures. In some embodiments, sole member 100 may include different components. For example, sole member 100 may include an outsole, a midsole, and/or an insole. In some cases, one or more of these components may be optional.

In some cases, sole member 100 may be configured according to one or more types of ground surfaces on which sole member 100 may be used. Examples of ground surfaces include, but are not limited to: natural turf, synthetic turf, dirt, natural grass, soft natural grass, as well as other surfaces. In some embodiments, sole member 100 may be provided with one or more cleat or stud systems comprising a plurality of cleat members. The term "cleat members" as used in this detailed description and throughout the claims includes any provisions disposed on a sole member for increasing traction through friction or penetration of a ground surface. In some cases, cleat members may be configured for football, soccer, baseball or any type of activity that requires traction.

In some embodiments, sole member 100 includes interchangeable cleat system 102, or simply cleat system 102. Cleat system 102 can comprise any number of cleat members that help enhance traction for sole member 100. In some embodiments, cleat system 102 can include at least two types of cleat members, including fixed cleat members and removable cleat members. The term "fixed cleat member" as used throughout this detailed description and in the claims refers to any cleat member that is permanently attached to sole member 100. In contrast, the term "removable cleat member" refers to any cleat member that can be removably attached to a portion of a sole member. For example, cleat members including threaded fasteners can engage corresponding receiving members in a sole member, which allows the cleat members to be attached and removed by screwing and unscrewing the cleat members.

In the current embodiment, cleat system 102 includes plurality of fixed cleat members 300 and plurality of removable cleat members 200. Plurality of fixed cleat members 300 further includes a first group of fixed cleat members 310 and a second group of fixed cleat members 320. The first group of fixed cleat members 310 may include first fixed cleat member 311, second fixed cleat member 312, third fixed cleat member 313, fourth fixed cleat member 314 and fifth fixed cleat member 315. Second group of fixed cleat members 320 may include sixth fixed cleat member 316 and seventh fixed cleat member 317.

Generally, a group of fixed cleat members could extend over any portion of sole member 100, including forefoot portion 10, midfoot portion 12 and/or heel portion 14. In some embodiments, first group of fixed cleat members 310 may be associated with forefoot portion 10. Additionally, in some cases, second group of fixed cleat members 312 may be associated with heel portion 14.

Although the current embodiment includes five fixed cleat members in forefoot portion 10 and two fixed cleat members in heel portion 14, other embodiments could include any other number of fixed cleat members in forefoot portion 10, midfoot portion 12 and heel portion 14. In some cases, the number of fixed cleat members could be selected according to desired traction properties for sole member 100.

Plurality of removable cleat members 200 further includes a first group of removable cleat members 210 and a second group of removable cleat members 220. The first group of removable cleat members 210 may include first removable cleat member 211, second removable cleat member 212, third removable cleat member 213, and fourth removable cleat member 214. Second group of removable cleat members 220 may include fifth removable cleat member 215 and sixth removable cleat member 216.

In some embodiments, sole member 100 includes provisions for receiving one or more removable cleat members. In some cases, sole member 100 includes plurality of cleat receiving portions 240. Each cleat receiving portion may be configured to receive a cleat member in a removable manner. In one embodiment, plurality of cleat receiving portions 240 includes first set of cleat receiving portions 250 and second set of cleat receiving portions 260. First set of cleat receiving portions 250 may comprise first cleat receiving portion 251, second cleat receiving portion 252, third cleat receiving portion 253 and fourth cleat receiving portion 254. Additionally, in some cases, second set of cleat receiving portions 260 can include fifth cleat receiving portion 255 and sixth cleat receiving portion 256.

In different embodiments, the mechanism for removably attaching a removable cleat member to a cleat receiving portion could vary. In some cases, a removable cleat member may be configured with a threaded fastener. In the current embodiment, each removable cleat member of plurality of removable cleat members 200 may include fastening portions 270 (see FIG. 1). For example, first removable cleat member 211 may include fastening portion 271 that comprises a threaded fastener. Additionally, each cleat receiving portion can include corresponding provisions for fastening a removable cleat member to sole member 100. In some cases, a cleat receiving portion includes a thread receiving cavity that is configured to fastenably engage a threaded fastener. In the current embodiment, each cleat receiving portion of plurality of cleat receiving portions 240 includes thread receiving cavity 280 that engages a threaded fastener. For example, first cleat receiving portion 251 includes thread receiving cavity 281 that engages with fastening portion 271 of first removable cleat member 211. This allows first removable cleat member 211 to be screwed onto sole member 100. In other embodiments, however, any other fastening mechanisms known in the art for removably attaching cleat members could be used.

Generally, a group of removable cleat members could extend over any portion of sole member 100, including forefoot portion 10, midfoot portion 12 and/or heel portion 14. In some embodiments, first group of removable cleat members 210 may be associated with forefoot portion 10. Additionally, in some cases, second group of removable cleat members 220 may be associated with heel portion 14.

Although the current embodiment includes four removable cleat members in forefoot portion 10 and two removable cleat members in heel portion 14, other embodiments could include any other number of removable cleat members in forefoot portion 10, midfoot portion 12 and heel portion 14. In some cases, the number of removable cleat members could be selected according to desired traction properties for sole member 100. It will also be understood that the number of cleat receiving portions on sole member 100 may be varied as the number of removable cleat members intended for use with sole member 100 is varied.

In some cases, the number of removable cleat members and fixed cleat members could be related to one another. For example, in some cases, a fixed cleat member could be used for each removable cleat member. Therefore, once the desired number of removable cleat members has been selected by a manufacturer for sole member 100, a fixed cleat member could be incorporated into the design of sole member 100 for each removable cleat member. In some cases, there may be more fixed cleat members than removable cleat members in a cleat system. For example, some removable cleat members may be associated with two or more fixed cleat members.

In different embodiments, the shape of each cleat member could be varied. In some cases, the shape of fixed cleat members could be substantially similar to the shape of removable cleat members. In other cases, the shape of fixed cleat members could be substantially different from the shape of removable cleat members. Moreover, in some cases, the shapes of at least two fixed cleat members could differ from one another. Likewise, in some cases, the shapes of at least two removable cleat members could differ from one another. While the current embodiment illustrates fixed cleat members with approximately similar shapes, other embodiments could incorporate fixed cleat members with different shapes at different locations on sole member 100. Also, while the current embodiment illustrates removable cleat members with approximately similar shapes, other embodiments could incorporate removable cleat members with different shapes at different locations on sole member 100.

In one embodiment, each of plurality of fixed cleat members 300 may be characterized by an elongated geometry. In some cases, each cleat member of plurality of fixed cleat members has a ridge-like geometry. In particular, the length of each cleat member may be substantially greater than the width of the cleat member. For example, as illustrated in FIG. 3, second fixed cleat member 312 has length L1 and width W1. In one embodiment, length L1 may be substantially greater than width W1 so that second fixed cleat member 312 appears elongated in the lengthwise or longitudinal direction. Each of the remaining fixed cleat members of plurality of fixed cleat members 300 could have substantially similar elongated or ridge-like shapes. The height of the fixed cleat members may vary and are characterized in more detail below.

In one embodiment, each of plurality of removable cleat members 200 may be characterized by a tapered geometry. In some cases, each cleat member of plurality of removable cleat members 200 may have a conically tapered shape. For example, as illustrated in FIG. 1, base portion 292 of second removable cleat member 212 may have a size that is approximated by diameter D1. Also, tip portion 294 of second removable cleat member 212 may have a size that is approximated by diameter D2. In some cases, diameter D1 may be substantially greater than diameter D2, which gives second removable cleat member 212 a tapered geometry. Moreover, the cross-sectional shape of second removable cleat member 212 may remain approximately circular along the height of second removable cleat member 212. Thus, the overall shape of second removable cleat member 212 may be characterized as conical, or as conical frustum.

Additionally, it will be understood that while the current embodiments use elongated fixed cleat members and conically tapered removable cleat members, in other embodiments cleat or stud members may have a variety of different cross sectional shapes, including but not limited to: hexagonal, cylindrical, conical, circular, square, rectangular, trapezoidal, diamond, ovoid, as well as other regular or irregular and geometric or non-geometric shapes.

In some embodiments, a majority of the fixed cleat members could be disposed on a periphery of sole member 100, as shown most clearly in FIG. 3. Likewise, in some cases, a majority of removable cleat members could be disposed on a periphery of sole member 100. In one embodiment, first fixed cleat member 311, second fixed cleat member 312, third fixed cleat member 313, fourth fixed cleat member 314, sixth cleat member 316 and seventh cleat member 317 may be disposed in outer peripheral region 120 of sole member 100. In contrast, in some cases, fifth fixed cleat member 315 may be disposed in central region 122 of sole member 100. Central region 122 may be a region disposed inwardly of outer peripheral region 120. Furthermore, in some cases, each of plurality of removable cleat members 200 could be disposed in outer peripheral region 120. In other embodiments, however, some of removable cleat members 200 could be disposed in central region 122.

Cleat system 102 can include provisions to help limit pressure on removable cleat members and prevent clogging. In some cases, the spacing between fixed cleat members and removable cleat members can be selected to help limit pressure on removable cleat members. In some cases, cleat system 102 may be arranged so that the distance between a removable cleat member and any adjacent fixed cleat members is approximately constant.

Referring now to FIG. 3, each removable cleat member can be associated with at least one adjacent fixed cleat member. For example, first removable cleat member 211 may be adjacent to first fixed cleat member 311, second fixed cleat member 312 and third fixed cleat member 313. In some cases, one fixed cleat member may be closest to first removable cleat member. In other cases, however, the distance to each adjacent cleat member could be approximately equal. In addition, fourth removable cleat member 214 may be adjacent to fourth fixed cleat member 314 and fifth fixed cleat member 315. In some cases, one fixed cleat member may be closest to each removable cleat member. In other cases, however, the distance to each adjacent cleat member could be approximately equal.

In some cases, second removable cleat member 212 may be associated with adjacent fixed cleat member 312 and third removable cleat member 213 may be associated with adjacent fixed cleat member 313. Likewise, fifth removable cleat member 215 may be associated with adjacent fixed cleat member 316 and sixth removable cleat member 216 may be associated with adjacent fixed cleat member 317.

In one embodiment, the relative spacing between a removable cleat member and any adjacent fixed cleat members could be approximately constant. For example, in the current embodiment, first removable cleat member 211 and first fixed cleat member 311 are separated by spacing S1. Likewise, spacing S2 designates the spacing between removable cleat member 212 and fixed cleat member 312, spacing S3 designates the spacing between removable cleat member 213 and fixed cleat member 313, spacing S4 designates the spacing between removable cleat member 214 and fixed cleat member 314, spacing S5 designates the spacing between removable cleat member 215 and fixed cleat member 316 and spacing S6 designates the spacing between removable cleat member 216 and fixed cleat member 317.

In some embodiments, spacing S1, spacing S2, spacing S3, spacing S4, spacing S5 and spacing S6 are approximately equal. For example, in some cases, spacing S1, spacing S2, spacing S3, spacing S4, spacing S5 and spacing S6 are all in the range approximately between 40% and 200% of the value of diameter D1, which represents the base diameter of the removable cleat members. In such an embodiment, the spacing between each removable cleat member and a corresponding adjacent (and/or closest) fixed cleat member is approximately constant. In other cases, however, each spacing could be substantially different.

In some cases, spacing S7, between removable cleat member 211 and fixed cleat member 312, as well as spacing S8, between removable cleat member 211 and fixed cleat member 315 could also be substantially equal to spacing S1, spacing S2, spacing S3, spacing S4, spacing S5 and spacing S6. In other cases, however, spacing S7 and spacing S8 could be substantially different. In such cases, the spacing between removable cleat members and adjacent fixed cleat members may only be approximately equal along an outer peripheral region 120 of sole member 100.

This configuration helps to limit pressure on the removable cleat members as cleat system 102 engages a ground surface. Loads that would be otherwise applied to each removable cleat member directly may be spread over the removable cleat member as well as any adjacent fixed cleat members. Moreover, by maintaining approximately even spacing between removable cleat members and adjacent fixed cleat members, loads may be somewhat evenly distributed over different removable cleat members.

Figure 4:
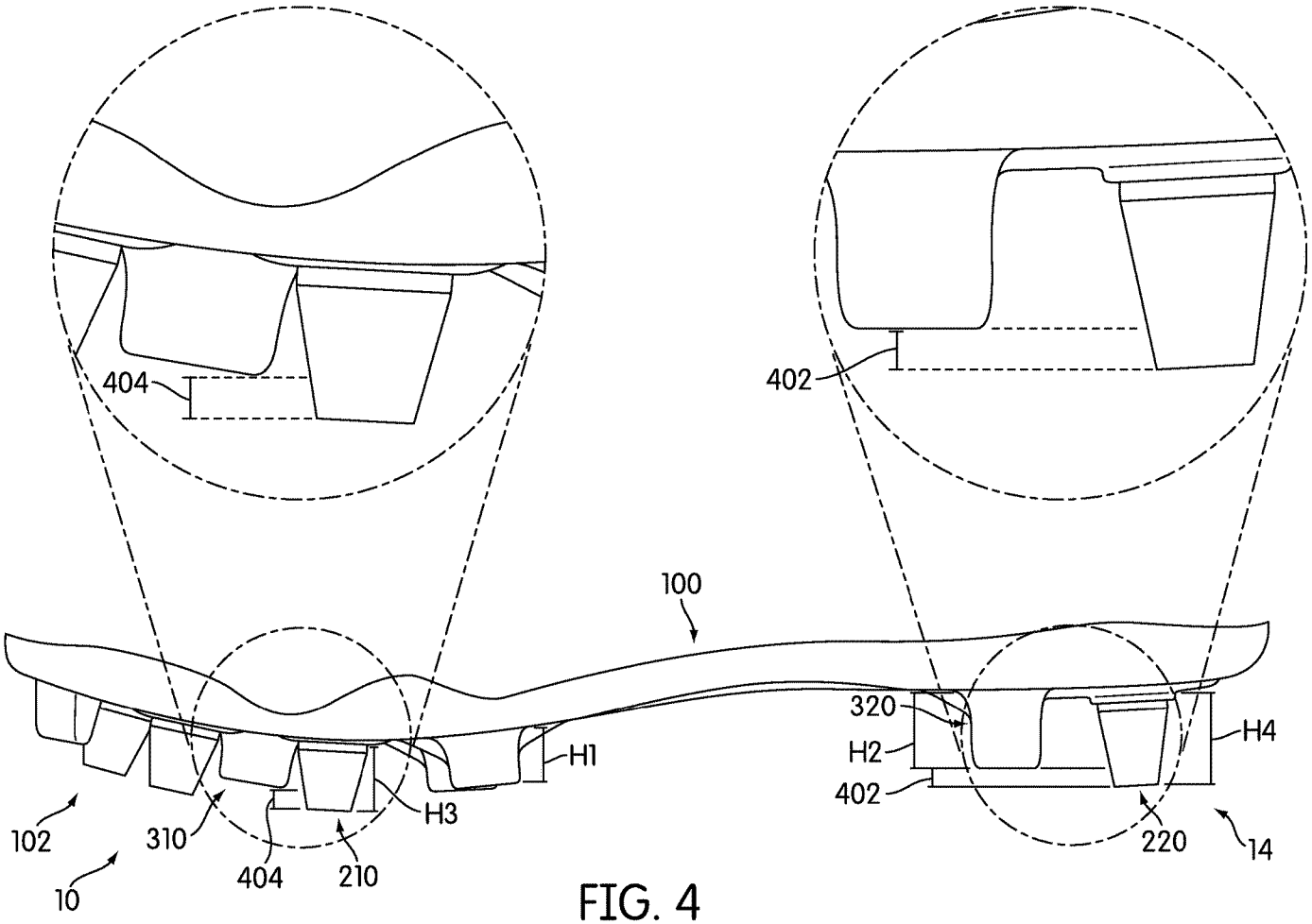
FIG. 4 is a side view of an embodiment of an outer sole member with a cleat system.

A cleat system for a sole member can include provisions for maintaining consistent surface penetration between different portions of the sole. Referring now to FIG. 4, the current embodiment comprises cleat member groups with substantially different heights. In some cases, first group of fixed cleat members 310 may have approximately similar heights, which is indicated in FIG. 4 as height H1. In some cases, second group of fixed cleat members 320 may have approximately similar heights, which is indicated as height H2. In addition, in some cases, first group of removable cleat members 210 may have approximately similar heights, which is indicated as height H3. Also, in some cases, second group of removable cleat members 220 may have approximately similar heights, which is indicated as height H4.

In some embodiments, the height difference between fixed cleat members and removable cleat members may be approximately constant over different portions of sole member 100. For example, in some cases, the difference in height between first group of fixed cleat members 310 and first group of removable cleat members 210 could be substantially equal to the different in height between second group of fixed cleat members 320 and second group of fixed cleat members 220. In an embodiment shown in FIG. 4, the difference in height between first group of fixed cleat members 310 and first group of removable cleat members 210 is indicated as height difference 404. Also, the difference in height between second group of fixed cleat members 320 and second group of removable cleat members 220 is indicated as height difference 402. In some cases, height difference 404 and height difference 406 could be substantially different. In one embodiment, height difference 404 is approximately equal to height difference 402. This provides a substantially consistent height difference between removable cleat members and fixed cleat members of cleat system 102 over the forefoot portion 10 and heel portion 14 of sole member 100. This consistent height difference may help maintain consistent ground penetration from forefoot portion 10 to heel portion 14.

The particular value of height difference 402 and height difference 404 could vary. In some cases, both height difference 402 and height difference 404 have a value approximately in the range between 0 and 6 mm. In some cases, height difference 402 and height difference 404 may have a value of approximately 2 mm. In other cases, however, height difference 202 and height difference 404 could have values greater than 4 mm. In an alternative embodiment, height difference 402 and height difference 404 may have a value of approximately 4 mm. Moreover, the height difference could occur in cases where the fixed cleat members are larger than the removable cleat members as well as in situations where the removable cleat members are larger than the removable cleat members. In other words, the term height difference, as used throughout this detailed description and in the claims, may be an absolute difference.

The values of height H1, height H2, height H3 and height H4 could vary in different embodiments. In one embodiment, height H1 has a value of approximately 9 mm, height H2 has a value of approximately 11 mm, height H3 has a value of approximately 11 mm and height H4 has a value of approximately 13 mm. This results in a relative height difference of about 2 mm between fixed cleat members and removable cleat members in both forefoot portion 10 and heel portion 10.

It will be understood that while the cleat members of a particular cleat group are characterized by a particular height, in some embodiments cleat members within a single cleat group could have slightly different heights. In such cases, the height associated with a cleat group may designate an average height for the cleat members of that group.

Embodiments may include provisions to allow a user to customize the height difference over different portions of a sole member. For example, increasing the height difference between fixed cleat members and removable cleat members in the forefoot portion and the heel portion may allow the sole member to penetrate further into a ground surface as more of the load is applied to the removable cleat members during initial contact with a ground surface.

Figure 5:
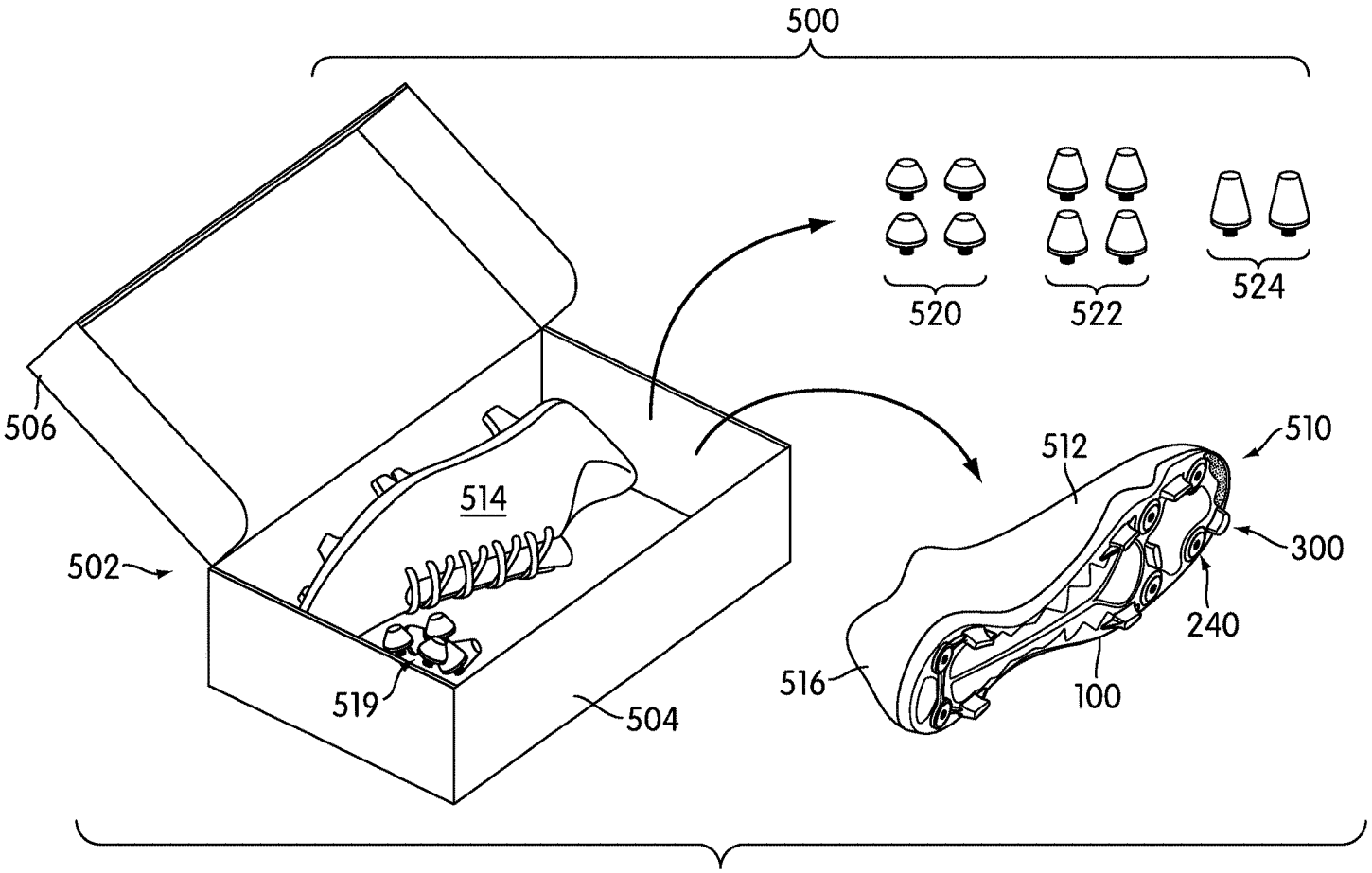
FIG. 5 is a schematic view of an embodiment of a kit of parts including a pair of footwear and three sets of removable cleat members.

FIG. 5 illustrates a schematic view of an embodiment of a kit of parts 500, or simply kit 500, which may include components of an interchangeable cleat system. In some cases, kit 500 may comprise one or more articles of footwear, accessories for these articles and/or a container for storing the articles. In other cases, kit 500 could include any other provisions not discussed below including, but not limited to: instructions, various kinds of media (such as CDs, DVDs, etc.), additional storage containers for storing articles and/or article accessories as well as any other provisions.

Kit 500 may be offered for sale at a retail location, such as a retail store, kiosk, factory outlet, manufacturing store and/or through an online vendor. In some cases, the various parts of kit 500 are sold together. In other cases, however, some parts of kit 500 may be sold separately. As an example, the current embodiment describes a kit of parts including a pair of footwear as well as three different sets of cleat members. In some cases, a retailer could sell a kit including the footwear and one or more sets of cleat members and the retailer could also sell one or more sets of cleat members separately from kit 500.

Kit 500 may include container 502. Container 502 can be any type of container configured to store at least one article of footwear. In some cases, container 502 may be a box. In an exemplary embodiment, container 502 may be a shoebox that is configured to store footwear. In particular, container 502 may have a generally rectangular shape and can include lower portion 504 and lid 506. In other embodiments, container 502 could be a bag, sack or other type of container. In still other embodiments, the various items in kit 500 may not be provided in a container.

In some embodiments, kit 500 includes pair of footwear 510. Pair of footwear 510 comprises first article of footwear 512 and second article of footwear 514. For purposes of clarity, first article of footwear 512, or simply article 512, is described in detail, however it will be understood that similar principles may apply to second article of footwear 514. In some cases, article 512 further includes upper 516. Article 512 may also include sole member 100. Sole member 100 may be further configured with plurality of fixed cleat members 300 as well as plurality of cleat receiving portions 240.

Kit 500, may also include multiple sets of cleat members. In the current embodiment, kit 500 includes first set of cleat members 520, second set of cleat members 522 and third set of cleat members 524, which may be configured for use with article 512. Kit 500 may also include additional sets of cleat members for use with second article of footwear 514, some of which are shown as cleat members 519.

Figure 6:
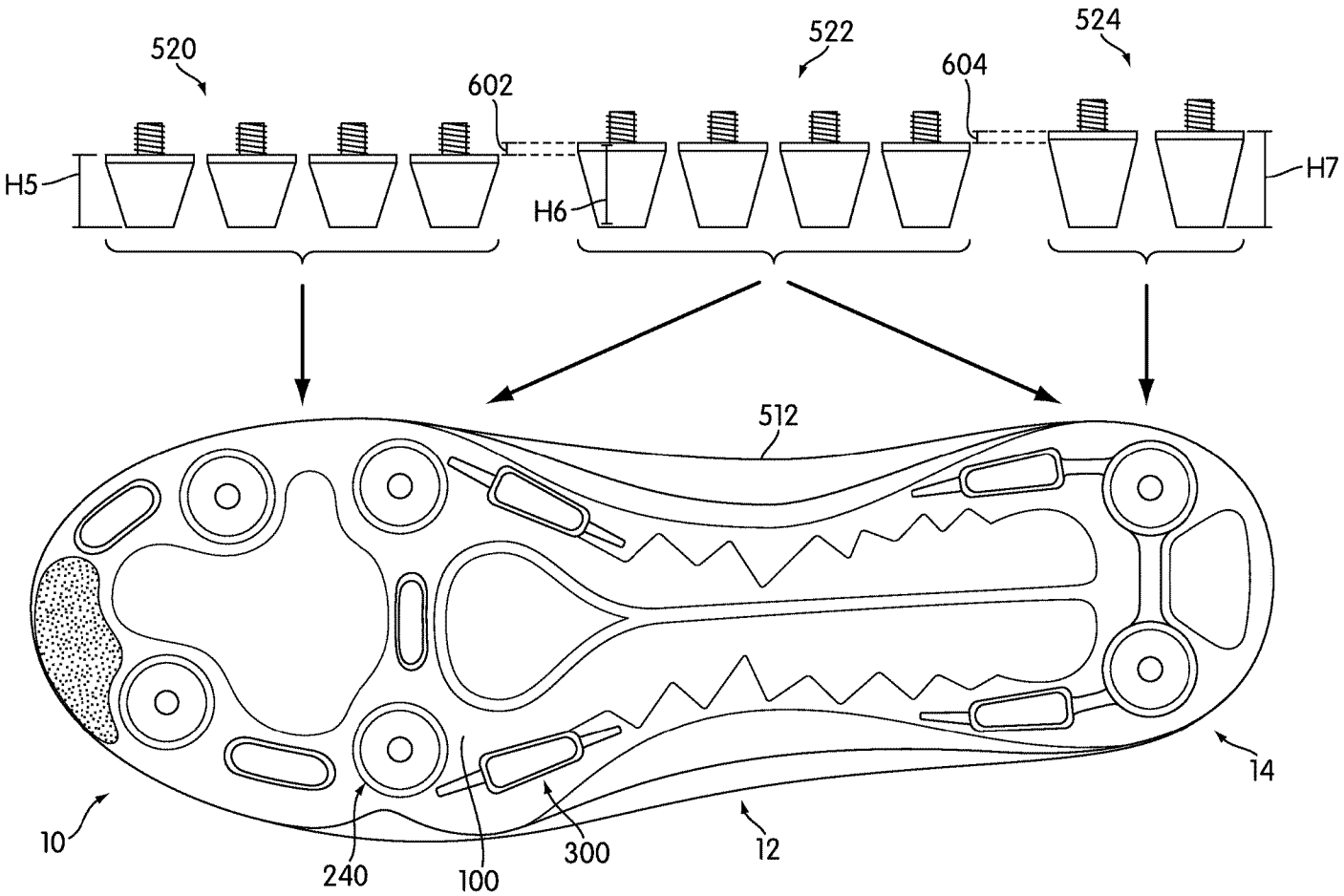
FIG. 6 is a schematic view of an embodiment of an outer sole member adapted to receive three different types of removable cleat members.

Referring now to FIG. 6, in some embodiments, each set of cleat members may be configured for use with one or more portions of sole member 100. In some cases, first set of cleat members 520 may be configured for use with forefoot portion 10. In addition, in some cases, third set of cleat members 524 may be configured for use with heel portion 14. Still further, in some cases, second set of cleat members 522 may be configured for use with either forefoot portion 10 or heel portion 14. This allows a user to adjust the positions of second set of cleat members 522 from heel portion 14 to forefoot portion 10, as discussed in further detail below.

The number of cleat members within each set of cleat members can vary. In some cases, first set of cleat members 520 and second set of cleat members 522 can include four removable cleat members. This arrangement allows either first set of cleat members 520 or second set of cleat members 522 to be incorporated into all four of the cleat receiving members in forefoot portion 10. In some cases, third set of cleat members 524 may include two removable cleat members since third set of cleat members 524 may only be used with heel portion 14, which itself includes only two cleat receiving portions.

In some embodiments, each set of cleat members may be configured with a characteristic size and/or geometry. In some cases, first set of cleat members 520 includes cleat members having height H5, second set of cleat members 522 includes cleat members having height H6 and third set of cleat members 524 includes cleat members having height H7. In some cases, height H5 is less than height H7, while height H6 has a value in between height H5 and height H7. In one possible configuration, height H5 has a value of approximately 11 mm, height H6 has a value of approximately 13 mm and height H7 has a value of approximately 15 mm. However, in other embodiments the heights of each set of cleat members could be any other values.

The configuration described here provides for a consistent increase in height in moving between first set of cleat members 520 and second set of cleat members 522 and in moving between second set of cleat members 522 and third set of cleat members 524. In one embodiment, first set of cleat members 520 and second set of cleat members 522 have a height difference 602. Also, second set of cleat members 522 and third set of cleat members 524 may have a height difference 604. In some cases, height difference 602 and height difference 604 may be approximately equal. In other cases, height difference 602 and height difference 604 may be substantially different.

Figure 7:
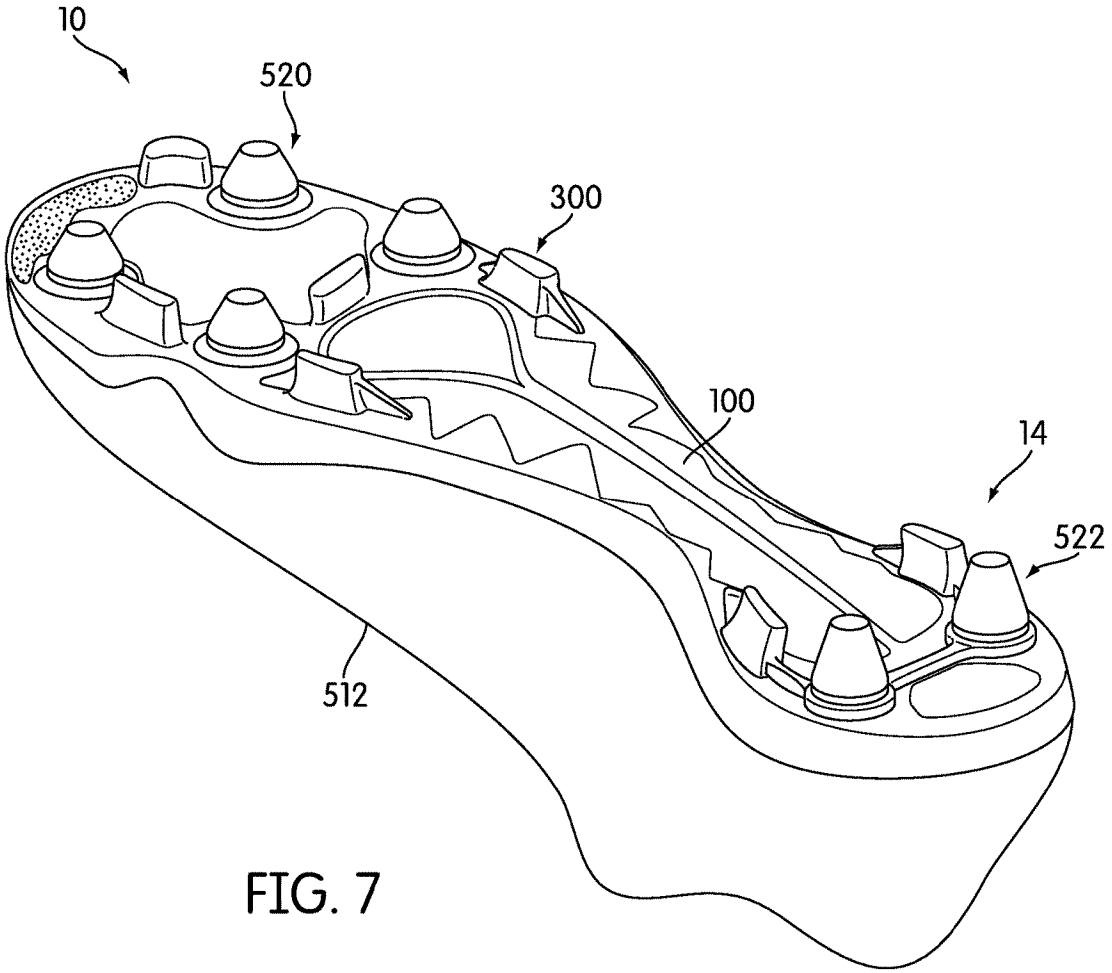
FIG. 7 is an isometric view of an embodiment of an outer sole member with a first set of removable cleat members installed in a forefoot portion and a second set of removable cleat members installed in a heel portion.
Figure 8:
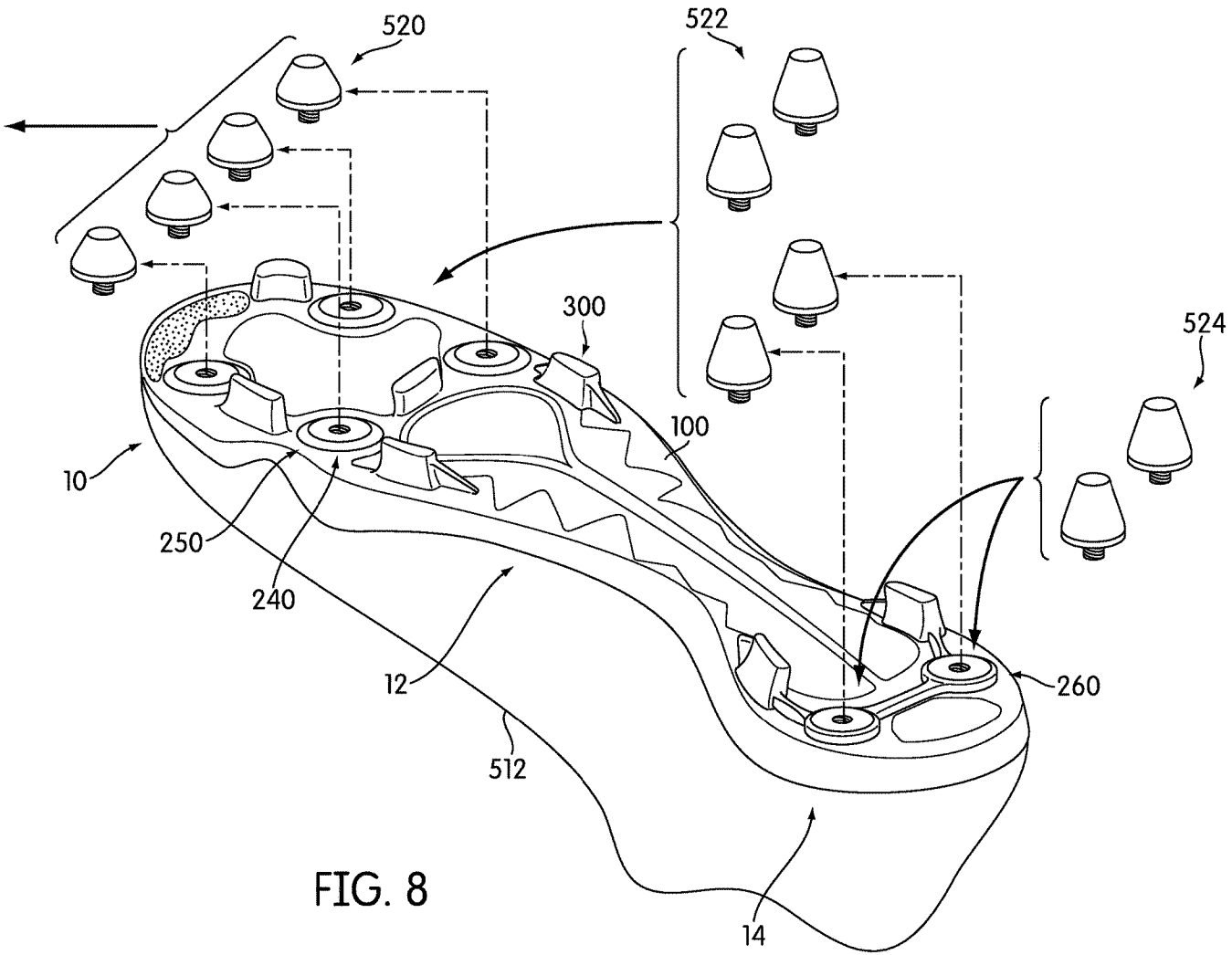
FIG. 8 is an isometric view of the outer sole member of FIG. 7, in which the first set of cleat members is removed, the second set of cleat members is moved to the forefoot portion and a third set of cleat members is moved to the heel portion.
Figure 9:
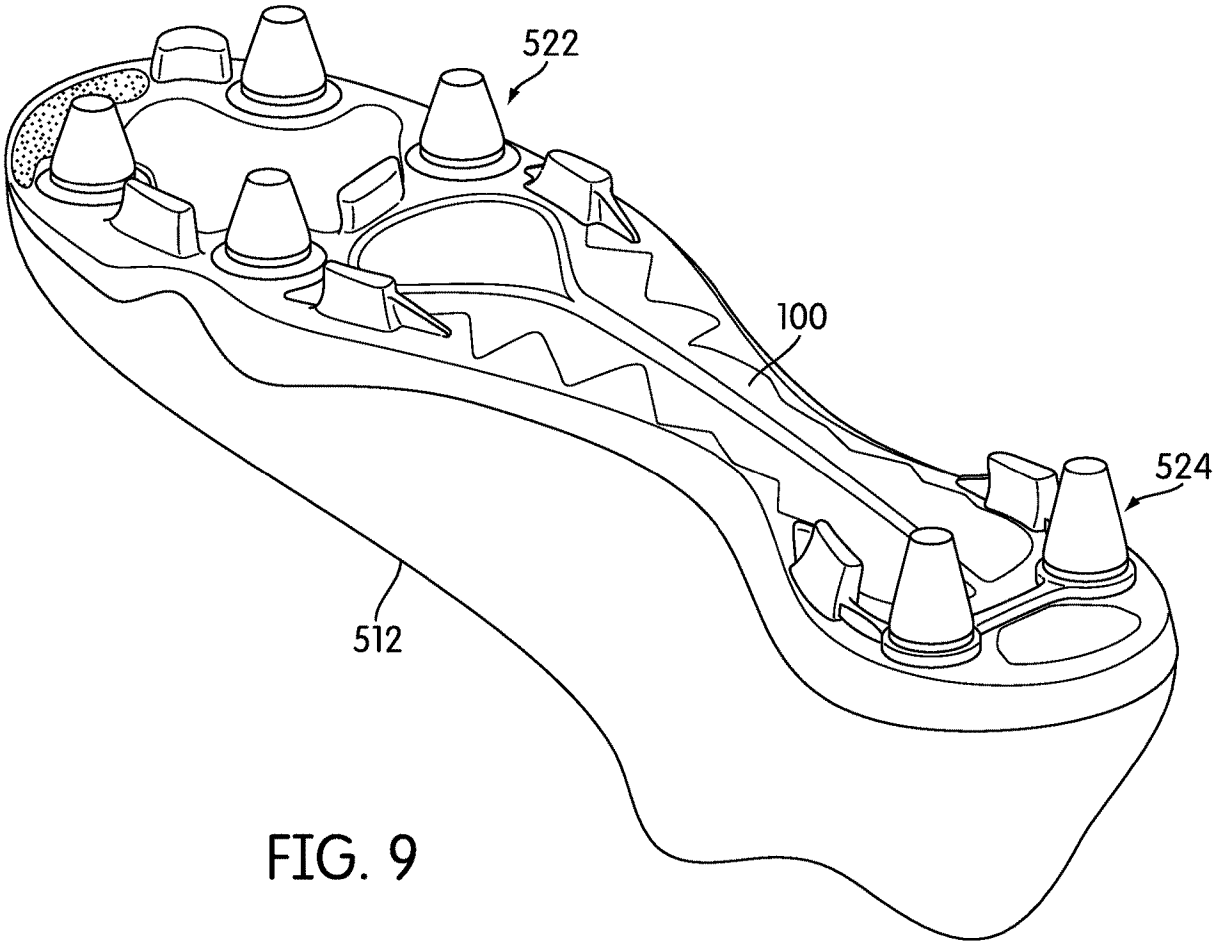
FIG. 9 is an isometric view of the outer sole member of FIG. 8, in which the second set of cleat members have been installed in the forefoot portion and the third set of cleat members have been installed in the heel portion.

FIGS. 7 through 9 illustrate a sequence where the sets of cleat members may be interchanged to modify the traction properties of sole member 100 according to one embodiment. Initially, as seen in FIG. 7, first set of cleat members 520 are attached to sole member 100 in forefoot portion 10. Also, second set of cleat members 522 are attached to sole member 100 in heel portion 14. Referring now to FIG. 8, to adjust the traction properties of sole member 100 a user may interchange first set of cleat members 520 with second set of cleat members 522 in forefoot portion 10. In particular, in some cases, each cleat member of first set of cleat members 520 may be removed from forefoot portion 10. Two of the cleat members from second set of cleat members 522 may be removed from heel portion 14 and inserted into first set of cleat receiving portions 250 of forefoot portion 10. Additionally, since only two cleat members of second set of cleat members 522 are initially attached to sole member 100, the remaining two cleat members of second set of cleat members 522 may located separately by the user and fastened to forefoot portion 10. Third set of cleat members 524, which may also be separately located by the user, can then be fastened to second set of cleat receiving members 260 in heel portion 14. The resulting configuration for sole member 100, shown in FIG. 9, provides for modified traction while maintaining consistent traction properties over different portions of sole member 100.

Figure 10:
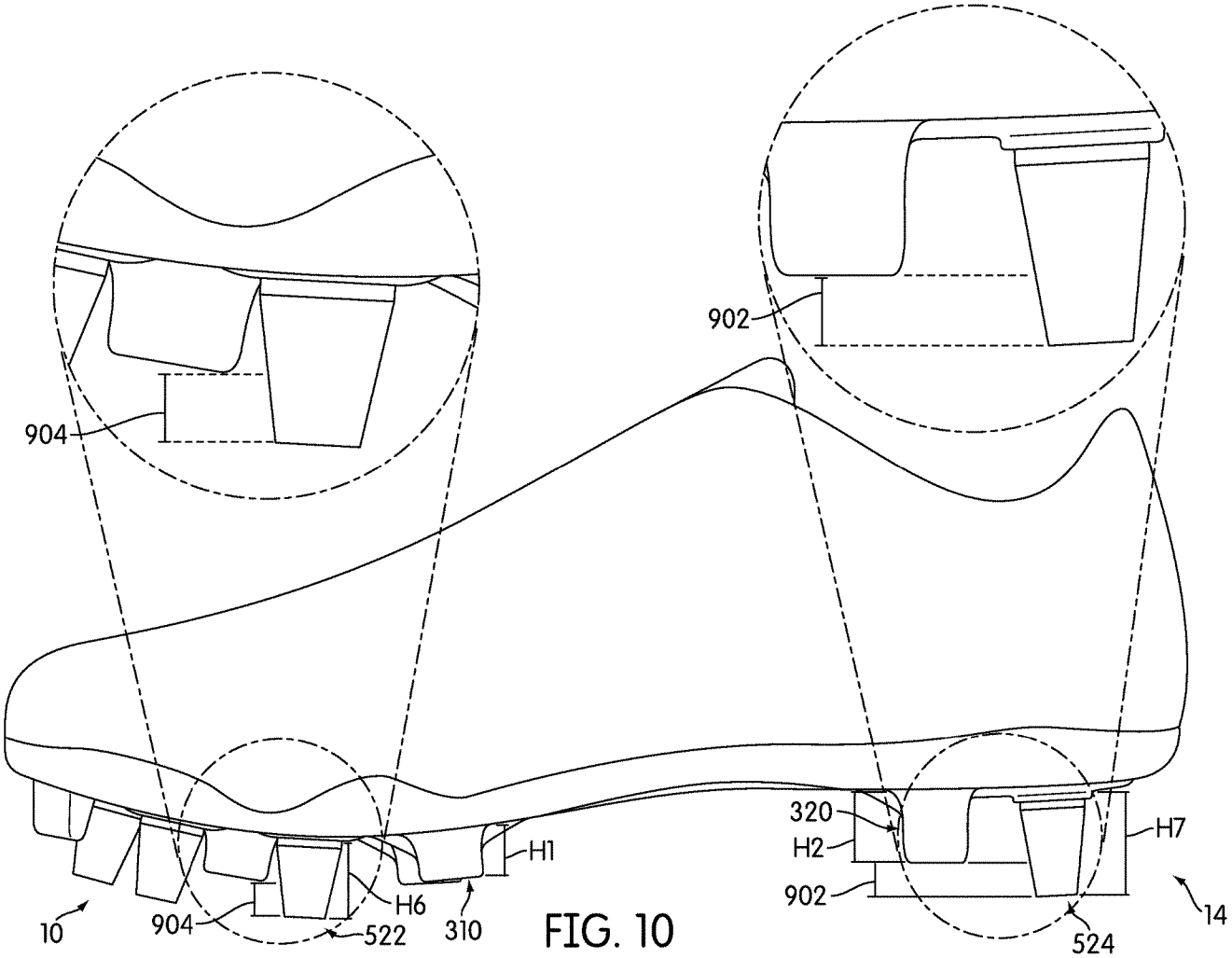
FIG. 10 is a side view of an embodiment of the outer sole member of FIG. 9.

FIG. 10 illustrates a side view of an embodiment of article 512. In the configuration shown, second set of cleat members 522 are installed in forefoot portion 10 and third set of cleat members 524 are installed in heel portion 14. In the current embodiment, each cleat member in second set of cleat members 522 may have an approximate height H6. Also, each cleat member in third set of cleat members 524 may have an approximate height H7. Additionally, as discussed with reference to FIG. 4, first group of fixed cleat members 310 may be associated with height H1. Second group of fixed cleat members 320 may be associated with height H2.

In some embodiments, the height difference between fixed cleat members and removable cleat members may be approximately constant over different portions of sole member 100. For example, in some cases, the difference in height between first group of fixed cleat members 310 and second set of cleat members 522 could be substantially equal to the difference in height between second group of fixed cleat members 320 and third set of cleat members 524. In an embodiment shown in FIG. 10, the difference in height between first group of fixed cleat members 310 and second set of cleat members 522 is indicated as height difference 904. Also, the difference in height between second group of fixed cleat members 320 and third set of cleat members 524 is indicated as height difference 902. In some cases, height difference 904 and height difference 902 could be substantially different. In one embodiment, height difference 904 is approximately equal to height difference 902. This provides a substantially consistent height difference between removable cleat members and fixed cleat members of cleat system 102 over the forefoot portion 10 and heel portion 14 of sole member 100. This consistent height difference may help maintain consistent ground penetration from forefoot portion 10 to heel portion 14.

The particular value of height difference 902 and height difference 904 could vary. In some cases, both height difference 902 and height difference 904 have a value approximately in the range between 0 and 8 mm. In some cases, height difference 902 and height difference 904 may have a value of approximately 4 mm. In other cases, however, height difference 902 and height difference 904 could have values greater than 4 mm. Moreover, the height difference could occur in cases where the fixed cleat members are larger than the removable cleat members as well as in situations where the removable cleat members are larger than the removable cleat members. In other words, the term height difference, as used throughout this detailed description and in the claims, may be an absolute difference.

The values of height H1, height H6, height H3 and height H7 could vary in different embodiments. In one embodiment, height H1 has a value of approximately 9 mm, height H2 has a value of approximately 13 mm, height H3 has a value of approximately 11 mm and height H4 has a value of approximately 15 mm. This results in a relative height difference of about 4 mm between fixed cleat members and removable cleat members in both forefoot portion 10 and heel portion 10.

A sole member could be made of any materials known in the art for use in sole structures. In some embodiments, a sole member may be made of a material that is configured to absorb forces applied by a foot. Examples of such materials include, but are not limited to: foams, including polyurethane foams, elastomers, rubbers as well as any other materials. A sole member could also be made of any materials including, but not limited to: plastics, composite materials including carbon fiber composites, glass fiber composites as well as any other durable materials known in the art. As previously discussed, in some cases, different articles of footwear can utilize different sole member materials to provide variations in cushioning, comfort and/or durability.

The description provided above is intended to illustrate some possible combinations of various features associated with an interchangeable cleat system. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure for an article of footwear, the sole structure comprising:

a first group of elongate fixed cleat members disposed in a forefoot region of the sole structure and having a first height;

a second group of elongate fixed cleat members disposed in a heel region of the sole structure and having a second height that is greater than the first height;

a first group of removable cleat members disposed in the forefoot region of the sole structure and including a third height, the cleat members of the first group of removable cleat members being spaced apart from the cleat members of the first group of elongate fixed cleat members by a first spacing; and a second group of removable cleat members disposed in the heel region of the sole structure and including a fourth height that is greater than the third height, the cleat members of the second group of removable cleat members being spaced apart from the cleat members of the second group of elongate fixed cleat members by a second spacing;

wherein the difference between the first height and the third height is substantially equal to the difference between the second height and the fourth height; and wherein a first removable cleat member of the first group of removable cleat members is disposed between and adjacent to a first fixed cleat member of the first group of elongate fixed cleat members disposed along a lateral side of the sole structure and a second fixed cleat member of the first group of elongate fixed cleat members disposed along the lateral side of the sole structure, the first fixed cleat member and the second fixed cleat member each including a longitudinal axis that extends along a longitudinal axis of the sole structure.

2. The sole structure of claim 1, wherein the first spacing is approximately equal to the second spacing.

3. The sole structure of claim 2, wherein the cleat members of the first group of elongate fixed cleat members alternate with the cleat members of the first group of removable cleat members along a medial side of the sole structure.

4. The sole structure of claim 1, wherein the first group of elongate fixed cleat members alternate with the first group of removable cleat members along a medial side of the sole structure.

5. The sole structure of claim 1, wherein the first spacing is approximately equal to the second spacing along an outer periphery of the sole structure.

6. The sole structure of claim 5, wherein the cleat members of the first group of elongate fixed cleat members follow a contour of a peripheral outer edge of the sole structure.

7. The sole structure of claim 6, wherein the cleat members of the second group of elongate fixed cleat members follow the contour of the peripheral outer edge of the sole structure.

8. The sole structure of claim 1, wherein the first spacing is within a range that is approximately between 40% and 200% of a diameter of a base of the cleat members of the first group of removable cleat members and the second spacing is within a range that is approximately between 40% and 200% of a diameter of a base of the cleat members of the second group of removable cleat members.

9. A sole structure for an article of footwear, the sole structure comprising:

a first group of elongate fixed cleat members disposed in a forefoot region of the sole structure and having a first height;

a second group of fixed cleat members disposed in a heel region of the sole structure and having a second height that is greater than the first height;

a first group of removable cleat members disposed in the forefoot region of the sole structure and including a third height, the removable cleat members of the first group of removable cleat members being spaced apart from the cleat members of the first group of fixed cleat members by a first spacing; and a second group of removable cleat members disposed in the heel region of the sole structure and including a fourth height that is greater than the third height, the removable cleat members of the second group of removable cleat members being spaced apart from the cleat members of the second group of fixed cleat members by a second spacing;

wherein the difference between the first height and the third height is substantially equal to the difference between the second height and the fourth height;

wherein the first spacing is approximately equal to the second spacing; and wherein a first removable cleat member of the first group of removable cleat members is disposed between and adjacent to a first fixed cleat member of the first group of elongate fixed cleat members disposed along a lateral side of the sole structure and a second fixed cleat member of the first group of elongate fixed cleat members disposed along the lateral side of the sole structure, the first fixed cleat member and the second fixed cleat member each including a longitudinal axis that extends along a longitudinal axis of the sole structure.

10. The sole structure of claim 9, wherein the cleat members of the first group of elongate fixed cleat members alternate with the cleat members of the first group of removable cleat members along a medial side of the sole structure.

11. The sole structure of claim 9, wherein the cleat members of the second group of fixed cleat members are elongate.

12. The sole structure of claim 9, wherein the cleat members of the first group of elongate fixed cleat members follow a contour of a peripheral outer edge of the sole structure.

13. The sole structure of claim 12, wherein the cleat members of the second group of fixed cleat members follow the contour of the peripheral outer edge of the sole structure.

14. The sole structure of claim 9, wherein the first spacing is within a range that is approximately between 40% and 200% of a diameter of a base of the cleat members of the first group of removable cleat members and the second spacing is within a range that is approximately between 40% and 200% of a diameter of a base of the cleat members of the second group of removable cleat members.

* * * * *